US009017342B1

(12) United States Patent
Vickers

(10) Patent No.: US 9,017,342 B1
(45) Date of Patent: Apr. 28, 2015

(54) HAIR THREADING SYSTEM

(75) Inventor: Rupa Russell Vickers, Asheville, NC (US)

(73) Assignee: Rupa Vickers Russe, Asheville, NC (US)

( * ) Notice: Subject to any disclaimer, the term of this patent is extended or adjusted under 35 U.S.C. 154(b) by 624 days.

(21) Appl. No.: 13/068,031

(22) Filed: May 2, 2011

Related U.S. Application Data

(60) Provisional application No. 61/411,402, filed on Nov. 8, 2010.

(51) Int. Cl.
*A61B 17/50* (2006.01)
*A45D 7/00* (2006.01)

(52) U.S. Cl.
CPC ..... *A45D 7/00* (2013.01); *A45D 2007/005* (2013.01)

(58) Field of Classification Search
USPC ..... D24/110.1; 128/206.13; 381/381; 606/133, 131
See application file for complete search history.

(56) References Cited

U.S. PATENT DOCUMENTS 2,081,779 A * 5/1937 Titus ..... 128/206.13
2009/0199856 A1* 8/2009 Berlin ..... 128/206.13

* cited by examiner

*Primary Examiner* — Ashley Fishback

(57) ABSTRACT

A Hair Threading Brace for the successful, sanitary operation of the Hair Threading procedure. The wearer of the threading brace can continue to offer the service of hair threading without requiring the wearer to either hold the thread in the mouth, a potentially unsanitary practice, or take the lengthy time to tie a loop around the neck. Additionally the wearer will be able to wind the thread around at least one bend on the device, which allows for the creation of a point of tension that can be used in the service of hair threading. The invention also calls for the addition of an optional wearers' mouth guard, which the wearer can choose to attach in order to protect both the wearer and the client from any debris that may be exhaled by the wearer, or caused by the threading technique, as is the case when the thread gently exfoliates skin off the client, into the air, by rubbing against its surface. The invention also covers an optional brace clasp, which when attached to the rear of the brace, specifically to two ear loops, creates a more secure brace for the wearer.

3 Claims, 7 Drawing Sheets

BRACE ON WEARER WITH THREAD ATTACHED

OVERHEAD VIEW

BRACE ON WEARER

BRACE ON WEARER WITH THREAD ATTACHED

SIDE VIEW

CLOSE-UP VIEW
Thread Bend

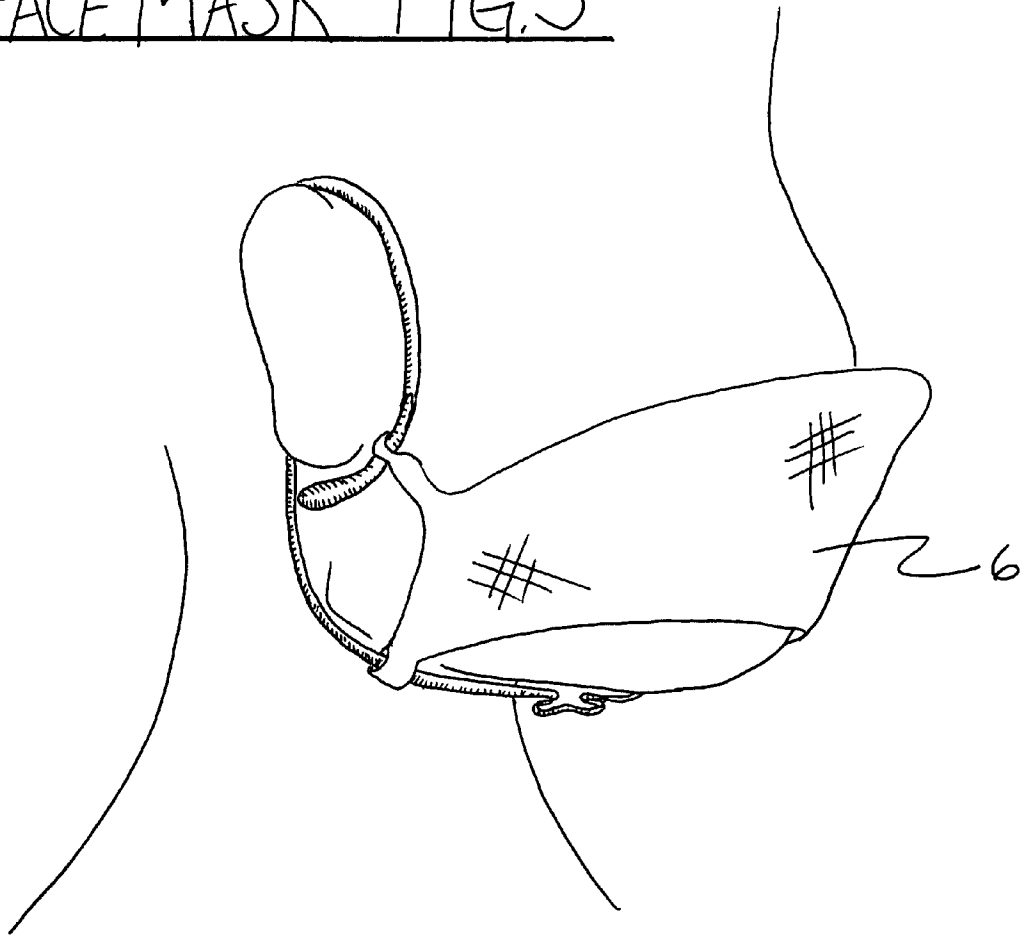
FACE MASK FIG. 5

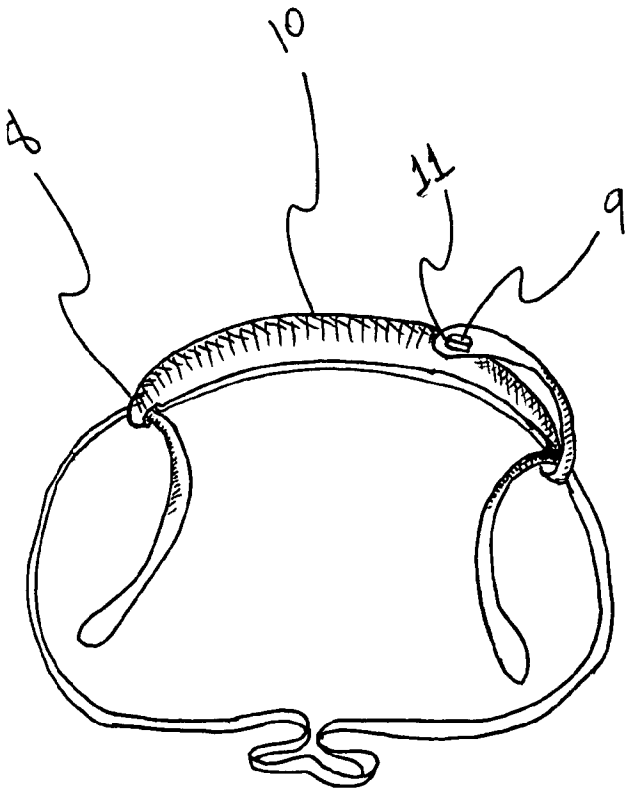
HEAD CLASP OVERHEAD VIEW FIG. 6

HAIR THREADING SYSTEM

I claim protection benefits from provisional Patent No. 61/411,402.

FIELD OF THE INVENTION

This invention relates to the technique of hair threading, which is a hair removal technique that removes the hair from the follicle of the skin. Hair threading replaces the need for waxing or tweezing.

BACKGROUND

It is appreciated that the method of hair threading is a potentially unsanitary and time consuming method for the removal of hair from the body. Traditional methods for creating a successful threading technique include holding the end point of a length of thread in the mouth. Other methods of hair threading include tying the end point of a single strand of thread around the neck, which is time consuming because it is not uncommon for the thread to break mid-service, thus requiring the threading technician to retie a new piece of thread multiple times within each service. Both of these methods use the same hand placements in order to create, via three points of tension, a manual loom for the thread to wrap around the desired hair to be removed, and by pulling on the different areas of the thread at specific moments within the process, can pull the hair from out of its follicle, thus achieving the desired removal of that hair. The hair threading technique is used in replacement of such hair removal techniques as "waxing" or "tweezing". Both "waxing" and "tweezing" techniques require the use of specific tools to achieve the technique. Historically the tools required for the successful use of the hair threading technique has been one wound piece of string and two human hands. It is appreciated that the traditional hair threading technique could successfully be accomplished with the addition of a tool that assisted the threading technician in not having to hold the thread in the mouth, or by having a tool that allowed the threading technician to not have to take the time necessary to tie the thread around the neck.

In summary, prior techniques for the achievement of the hair threading method suffer from the disadvantages that they create a potentially unsanitary situation for both the practitioner and the client; they require a timely process that can require the method to take longer than necessary.

SUMMARY OF INVENTION

A hair threading system that includes a brace that is to be worn on the human head for securing the end point of thread to, with an aspect of the present invention comprising ear loops, one for each ear, and an underchin bend, such as a cleat, whereby the end point of thread can be attached securely onto the invention without the thread making contact with the technicians saliva, or skin.

The improvement comprises:

(1) at least one piece of material that loops around the outer ear;

(2) said material continues under the chin;

(3) said material forms a bend or a cleat;

(4) said material continues under the chin and forms an ear loop that loops around the other outer ear;

(5) said material can have ear padding for the comfort of the wearer;

(6) said brace can include the additional attachment of a nostril/mouth protector; and (7) said brace can include the additional attachment of a clasp to the ear loops, that further supports the brace on the head of the wearer.

In the present invention, the brace of the hair threading system does not significantly protrude from the skin of the wearer. The device of the present invention requires a thread end point to be wound or looped around the angle of the bend, or cleat, in order to engage and hold tension on the end of the thread when the other end of the thread is held in the hand of the wearer. The device is applicable to the technique of hair threading. The hair threading method can be used on a variety of body skin surfaces that require the removal of hair from the follicle.

BRIEF DESCRIPTION OF THE DRAWINGS

Preferred embodiments of the invention are shown in the drawings, wherein:

FIG. 5 is a side view of the face mask.

FIG. 6 is a overhead view of the head clasp

DETAILED DESCRIPTION OF THE PREFERRED EMBODIMENTS

It is appreciated that the technique of threading is an ancient historical method of hair removal, which involves the use of twisted thread to grab and remove hair from the root of the hair follicle. However, there are presently no tools available to the hair threading technician in the marketplace that allows for the sanitary and timely use of the technique. It is, of course, appreciated that the invention would apply to any other type of system used for the function of removing hair with thread.

Figure 1:
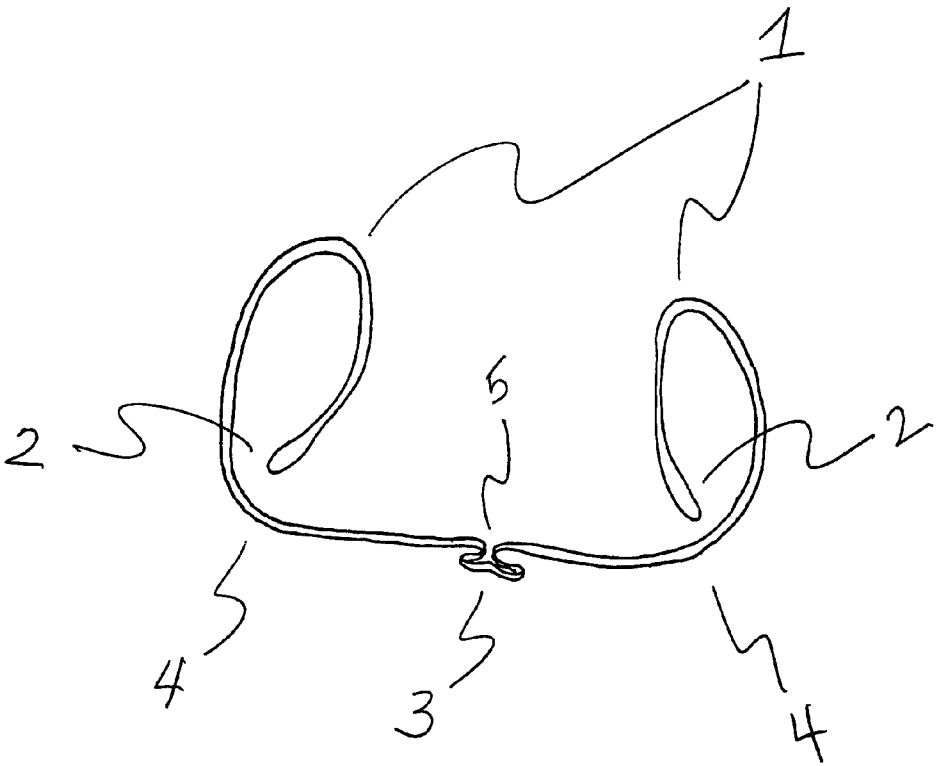
FIG. 1 is an overhead view of the invention.

With reference to FIG. 1 the brace of the hair threading system comprises at least one ear loop 1. The ear loop 1 runs behind the back of the ear. The material then bends down under the jaw 4, culminating in a point of at least one angle which creates a bend, or with multiple bends (see FIGS. 3 and 5) a cleat 3, which is a point of attachment for the thread to connect to by either a winding of the thread, or looping of it around the angle of the bend. Said material continues under the jaw to the opposite ear where it bends 4 up behind the ear and loops around to the front of the ear, ending in a secondary ear loop 1.

Figure 2:
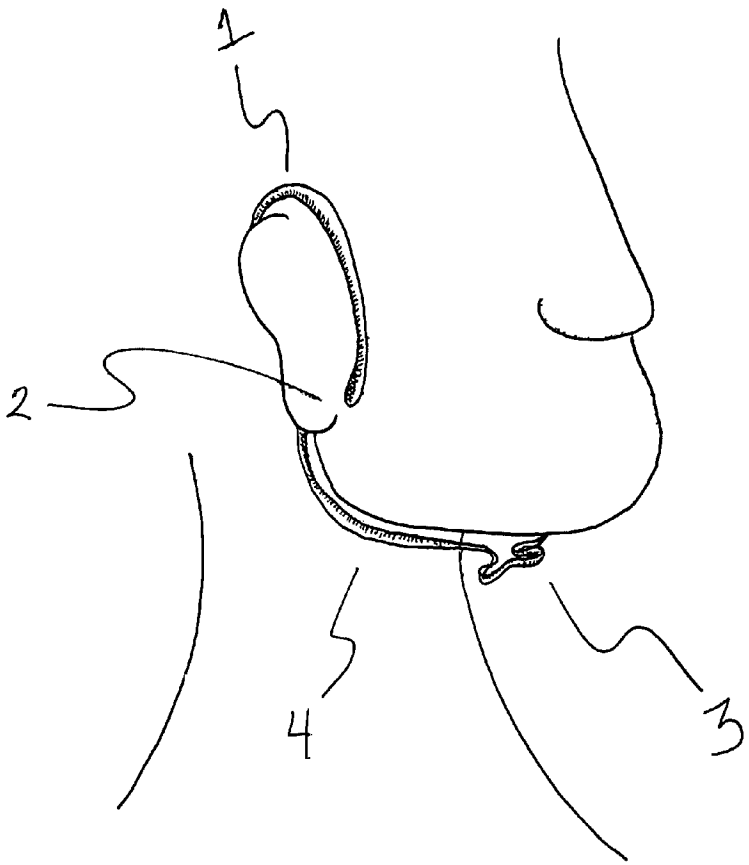
FIG. 2 is a side view perspective of the invention, while being worn on the human head.

FIG. 2 shows the brace of the hair threading system as being worn by the wearer. FIG. 2 shows how the system will assist the wearer in performing the hair threading removal technique, by indicating the direction of the ear loops 1.

Figure 2A:
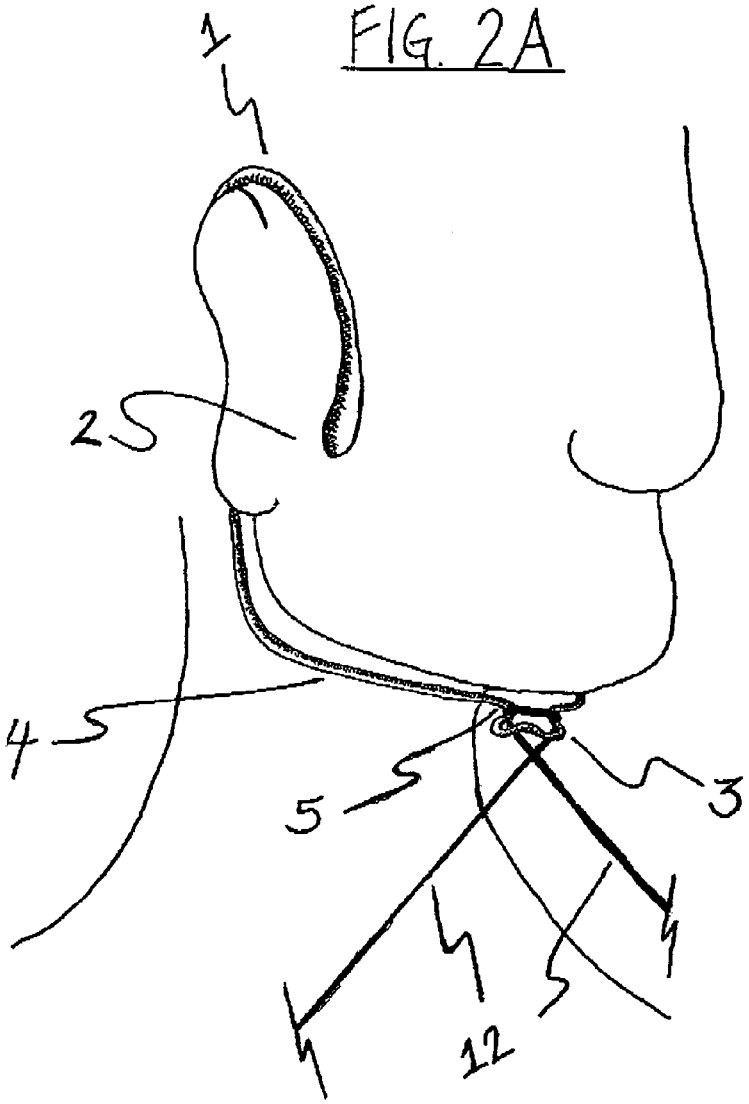
FIG. 2A is a side view perspective of the invention, while being worn on the human head, with thread 12 attached to cleat.

FIG. 2A shows the hair threading system as being worn by the wearer with thread 12 attached. FIG. 2A shows how the thread 12 is attached to the cleat under the chin of the wearer 5.

Figure 3:
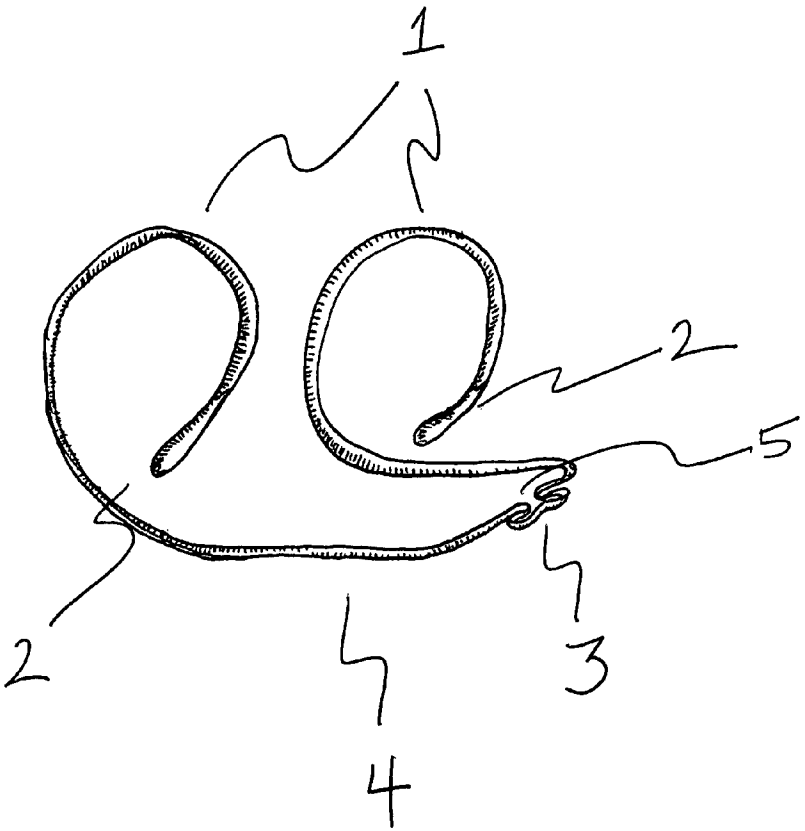
FIG. 3 is a side view of the invention.

FIG. 3 shows the side view of the hair threading system's brace. 3 and 5 indicate the potential additional bends, or angles which can be formed in order to create a more dimensional cleat for the thread 12 to be attached to.

Figure 4:
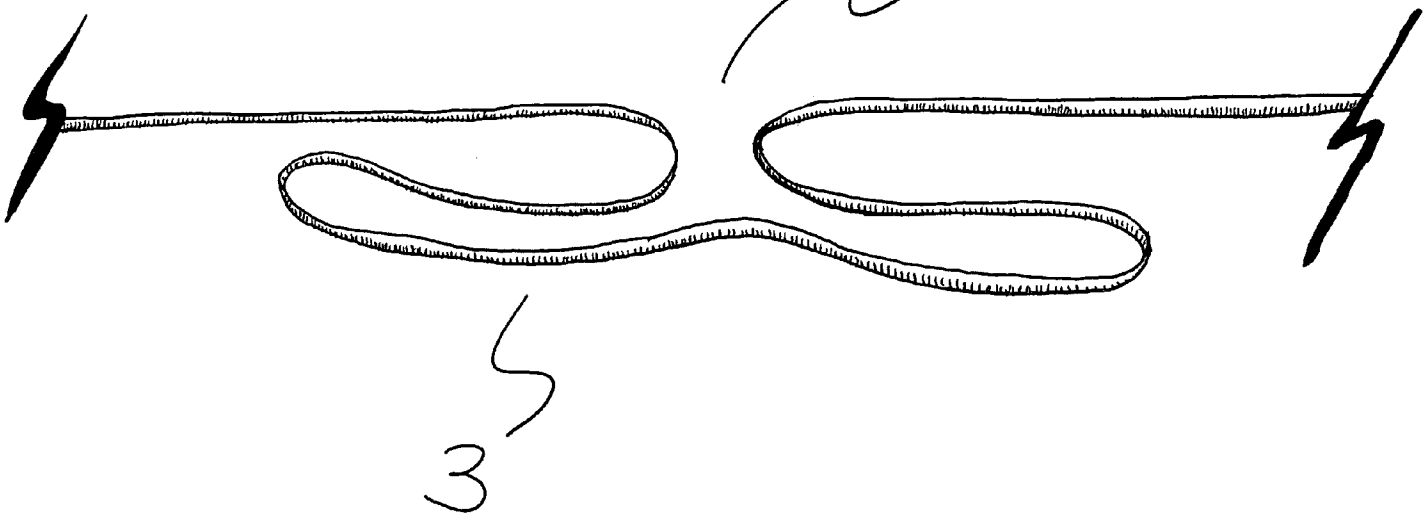
FIG. 4 is a close-up view of the bend, or cleat embodiment.

FIG. 4 shows a close-up view of the bend, or with multiple angles in the bend, the cleat 3 indicates an outer edge of the bend, which provides a surface for the thread 12 to wrap around. 5 indicates the inner bend, which allows for a pathway of the thread 12 to be attached to. Both 3 and 5 can work in tandem to create a surface away from the neck for the thread 12 to attach to.

FIG. 5 shows the attached face mask, which is affixed to the hair threading system's brace with at least two loops 7. The face mask is made of cut plastic material which when attached via the loops 7 creates an optional additional face mask 6 for the wearer to use to cover their mouth and nostril area while performing the hair threading technique while using hair threading system.

FIG. 6 shows the head clasp 10 from an overhead perspective. The head clasp is used when the device is constructed as shown in FIG. 6 with two ear loops. This optional additional clasp 10 is constructed of either one solid piece of elastic or plastic with a loop 8 on one end, and a long piece of material that has at least one button-hole cut out of it, to accommodate the molded plastic button which is an integrated body of the clasp itself. It is affixed by threading the clasp loop 8 over one of the ear loops and once the wearer has placed the brace on the head, the clasp is then looped around the second ear loop and affixed by inserting the plastic button 9 into the button-hole 11 of the clasp. This additional feature helps achieve a more secure brace for the wearer, which allows for a better technique. The clasp 10 is an optional improvement however, and does not preclude the wearer from successfully using the hair threading system's brace without it.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A hair threading system comprising: a hair threading thread; and a hair threading brace, said hair threading brace comprising: a continuous piece of material having two ends configured for the attachment of the hair threading thread for the purpose of anchoring an end-piece of the thread in order to achieve a point of tension, wherein said continuous piece of material comprises an ear loop on one end, thereby forming a first ear loop, said first ear loop comprising a curve that is configured to be positioned in front of a wearer's ear to alongside the back of the wearer's ear, the continuous piece of material further comprising a bend at a middle portion between said two ends, wherein said bend is configured to be positioned under the wearer's chin, said bend having at least one angle configured for the attachment and anchoring of an end of the hair threading thread, said continuous piece of material further comprising a second ear loop at the other end opposite the first ear loop, said second ear loop comprising a curve that is configured to be positioned on a second ear of the wearer.

2. The hair threading system as in claim 1, further comprising a clasp configured to be attached to the first and second ear loops.

3. The hair threading system as in claim 2, wherein the clasp is configured to be affixed behind the crown of the wearer's head, in order to maintain firm pressure of the hair threading brace against the head.

* * * * *